US006631600B2

(12) United States Patent
Schiedegger et al.

(10) Patent No.: US 6,631,600 B2
(45) Date of Patent: Oct. 14, 2003

(54) CORNER BRICK BLOCK

(75) Inventors: Charles E. Schiedegger, Metamora, MI (US); J. Richard Logan, Oxford, MI (US); Aundrea Nurenberg, Brown City, MI (US); Clyde G. Allen, North Branch, MI (US)

(73) Assignee: Tapco International, Plymouth, MI (US)

( * ) Notice: Subject to any disclaimer, the term of this patent is extended or adjusted under 35 U.S.C. 154(b) by 0 days.

(21) Appl. No.: 10/066,817

(22) Filed: Feb. 4, 2002

(65) Prior Publication Data

US 2003/0145553 A1 Aug. 7, 2003

(51) Int. Cl.[7] ..... E04F 13/00

(52) U.S. Cl. ..... 52/658; 52/287.1; 52/288.1; 348/345.1

(58) Field of Search ..... 52/287.1, 288.1, 52/658; 248/345.1

(56) References Cited

U.S. PATENT DOCUMENTS 2,373,789 A * 4/1945 Smith ..... 52/282.3
3,717,968 A * 2/1973 Olsen et al. ..... 52/288.1
3,828,499 A * 8/1974 Leddy ..... 52/278
4,127,974 A * 12/1978 Wendt ..... 52/287.1
4,827,683 A * 5/1989 Poole ..... 52/316
5,363,617 A * 11/1994 Miller ..... 52/288.1
5,836,123 A 11/1998 Gulino ..... 52/288.1
6,035,599 A * 3/2000 Sonnentag ..... 52/604
6,119,416 A * 9/2000 Larson ..... 52/212
D456,089 S * 4/2002 Shaw et al. ..... D25/139
6,427,414 B1 * 8/2002 Wing ..... 52/590.1

* cited by examiner

*Primary Examiner*—Korie Chan
*Assistant Examiner*—Ingrid Weinhold

(57) ABSTRACT

A corner block assembly comprises a corner block and a mortar joint. The corner block has at least two faces arranged in a predefined angular relationship and joined along adjacent edges thereof. Each face has a top flange extending rearwardly from a top edge and at an edge opposite from the joined edge an arm extending rearwardly therefrom. The mortar joint is affixed to the top flanges of the corner block and has at least two legs arranged in a like predefined angular relationship. Each leg has a rear attachment flange for abutting one of the intersecting walls and a front cap spaced from the attachment flange wherein a bottom edge of the front cap abuts at the top of the corner block.

33 Claims, 4 Drawing Sheets

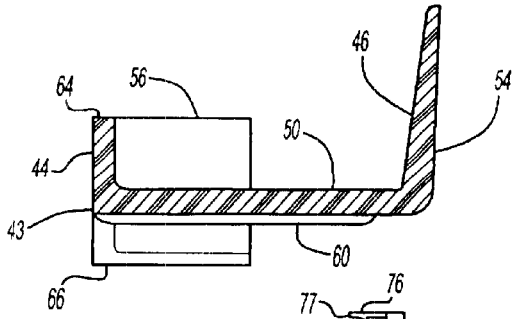
Fig-11
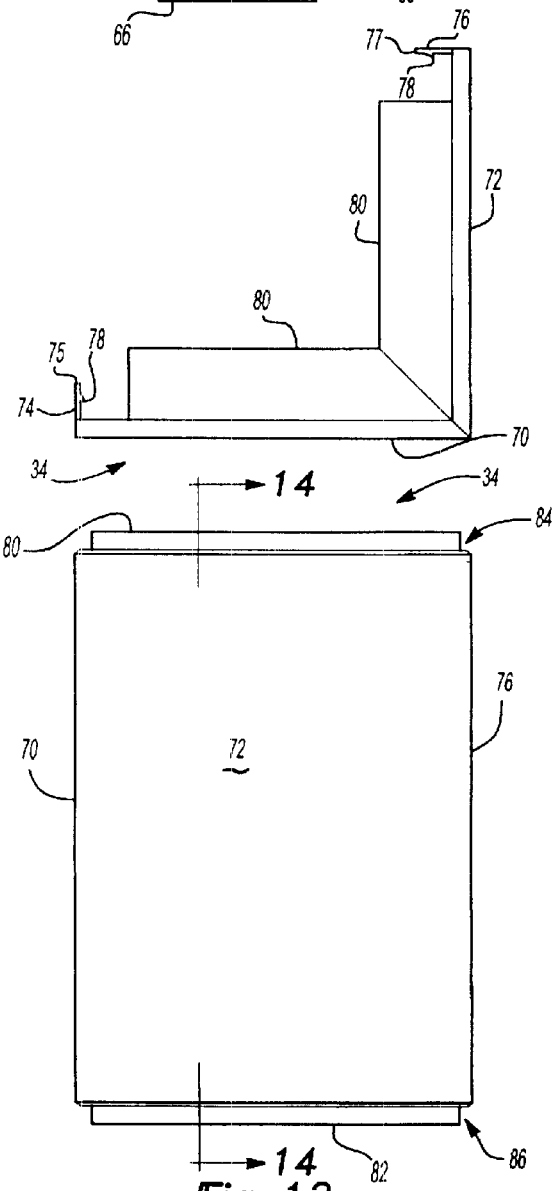
Fig-13
Fig-12
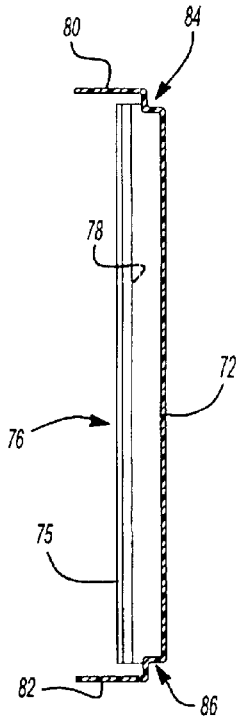
Fig-14

CORNER BRICK BLOCK

TECHNICAL FIELD

This invention relates to decorative moldings for covering the outside walls of residential or commercial structures, and more particularly to a decorative corner block molding for decoratively covering an exterior corner of a residential or commercial structure.

BACKGROUND OF THE INVENTION

Molding assemblies are used in a variety of applications to cover the exterior walls of a building structure to provide a decorative, aesthetically appealing building exterior. In recent years, these exterior building coverings have transitioned from materials such as wood and aluminum to being manufactured from plastics such as high-density polyurethane or vinyl. In general, plastics provide significant advantages over previous materials. For example, exterior molding and siding components manufactured from plastic are low in maintenance when compared with natural wood molding and siding. Plastic exterior molding and siding is not susceptible to moisture and therefore will not decay, warp, or splinter like natural wood. Additionally, exterior components made of thin gage aluminum, while not susceptible to moisture and decay, are susceptible to permanent deformation when accidentally struck by objects through the lifetime of the building, or could be extensively damaged during a major catastrophe such as a hailstorm. Advantageously, plastic exterior components can be sawed, drilled, glued or nailed just like natural wood. Still further, during the manufacture of plastic siding components, plastic can be tinted with dyes or other materials to provide siding components that are of desired colors, thus obviating the need for painting prior to or subsequent to installation on a structure.

Prior developed siding systems generally incorporate a corner molding that is attachable to the corner of the building structure wherein the molding includes a laterally facing channel to receive one end of the siding that is being terminated at the corner of the structure. Additionally, the siding systems employ J-channels at areas such as the sides of windows where only the siding from one surface of the building exterior is to be terminated. Thus, a typical siding system incorporates lengths of siding elements that can be cut to a desired length and wherein the cut ends are covered by a combination of exterior corners, interior corners, or J-channels to provide a more aesthetic appearance and to prevent elements of nature from intruding into exposed spaces at the cut ends of the siding elements.

Builders and building owners often desire to include a variety of decorative trim and moldings on a building to improve its aesthetic value. These extra decorative elements often include door surrounds, window frames, and headers for windows and doors. One feature found on many homes constructed of brick and stone is the use of square stones or bricks at the corners of the buildings to aesthetically enhance the building's appearance. However, the installation of actual or synthetic stone at the corners of the structure can be cost prohibitive or excessively time consuming on structures that utilize plastic siding systems as discussed above. Thus, it would be advantageous to have a corner block system for attachment to a building exterior corners that is also molded from plastic and incorporating features thereon to make the installation relatively fast and simple while at the same time incorporating features to utilize and interface with existing elements of known plastic molding and siding systems.

SUMMARY OF THE INVENTION

One aspect of the present invention is a corner block system for covering exterior corners of intersecting building walls. The corner block system includes an elongated, vertically oriented bracket for attachment to each of the intersecting building walls. A plurality of mortar joints have at least two legs arranged in a predefined angular relationship, wherein each leg has a rear attachment flange for abutting one of the intersecting walls and a front cap spaced from the attachment flange. A plurality of corner blocks have at least two faces arranged in a like predefined angular relationship and are joined along adjacent edges thereof. Each face has at an edge opposite from its joined edge an arm extending rearwardly therefrom. The corner blocks are vertically arranged between the vertically oriented brackets wherein each arm of the blocks retainingly engages the bracket. One of the mortar joints is interposed between adjacent ones of the corner blocks wherein a top of the bottommost of the vertically adjacent corner blocks abuts a bottom of the mortar joint front cap and a top of the mortar joint front cap abuts a bottom of a topmost of the vertically adjacent corner blocks.

Another aspect of the present invention is a corner block assembly for covering exterior corners of intersecting building walls. The corner block assembly comprises a corner block having at least two faces arranged in a predefined angular relationship and joined along adjacent edges thereof. Each face has a top flange extending rearwardly from a top edge and at an edge opposite from the joined edge an arm extending rearwardly therefrom. A mortar joint is affixed to the top flanges of the corner block. The mortar joint has at least two legs arranged in a like predefined angular relationship wherein each leg has a rear attachment flange for abutting one of the intersecting walls and a front cap spaced from the attachment flange wherein a bottom edge of the front cap abuts the top of the corner block.

Yet another aspect of the present invention is a method of installing a corner block system to an exterior corner of intersecting walls of a building wherein the corner block system includes at least two elongated brackets, a plurality of corner blocks having at least two faces arranged in a predefined angular relationship and joined along adjacent edges thereof. Each face of the corner block has a top flange extending rearwardly from a top shoulder defined by the top flange and the face, and an arm extending rearwardly from an edge of each face opposite from the joined edge and further has a protrusion on an inner surface. The system also includes a plurality of mortar joints having at least two legs arranged in a like predefined angular relationship wherein each leg has a rear attachment flange and a front cap spaced from the attachment flange by a web extending between the cap and attachment flange. The method includes the steps of attaching one of the brackets to each of the intersecting walls a predefined distance from the corner. The attachment flange of a mortar joint is abutted to the corner substantially at a bottom edge of the intersecting walls. The mortar joint is attached to the walls at the attachment flange. A corner block is then placed on the mortar joint such that the bottom shoulder of the corner block abuts a top edge of the mortar joint front cap. The arms of the corner block engage a free edge of the bracket by snapping the arm protrusions over the bracket-free edge. Mortar joints and corner blocks are alternatingly affixed to the corner of the building in a like manner until the installation reaches a top of the intersecting walls of the building.

These and other advantages of the invention will be further understood and appreciated by those skilled in the art by reference to the following written specification, claims and appended drawings.

BRIEF DESCRIPTION OF THE DRAWINGS

FIG. 11 is an elevational cross-section extending laterally across one of the arms of the mortar joint along the Line 11—11 of FIG. 8.

FIG. 12 is an elevational view of one side of a corner block.

FIG. 13 is a top plan view of the corner block of FIG. 12.

FIG. 14 is an elevational cross-section of the block of FIG. 12 taken along the Line 14—14.

DETAILED DESCRIPTION OF THE PREFERRED EMBODIMENT

Figure 2:
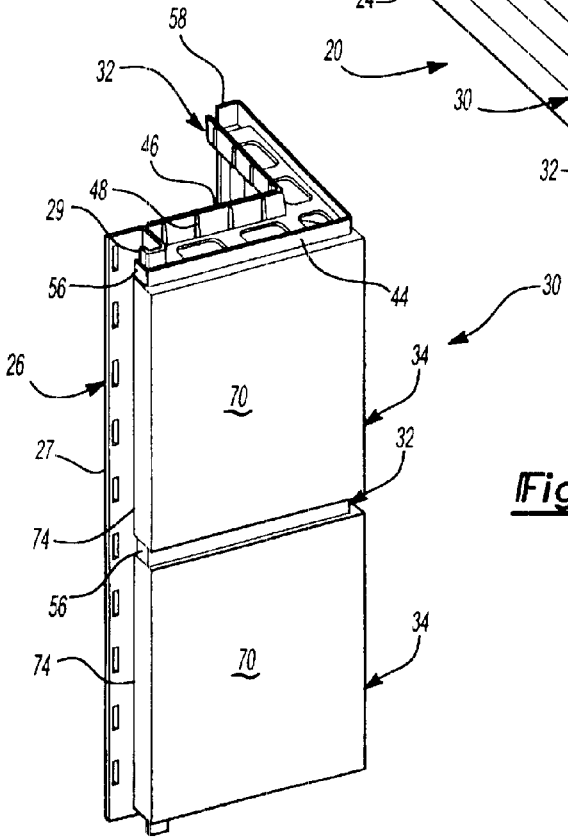
FIG. 2 is an enlarged perspective view of the partial block installation of FIG. 1 without the building structure shown.

For purposes of description herein, the terms "upper," "lower," "right," "left," "rear," "front," "vertical," "horizontal," and derivatives thereof shall relate to the invention as oriented in FIG. 2, the exterior of the elements being designated as "front" and the part of the elements most proximate the building wall being the "rear". However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
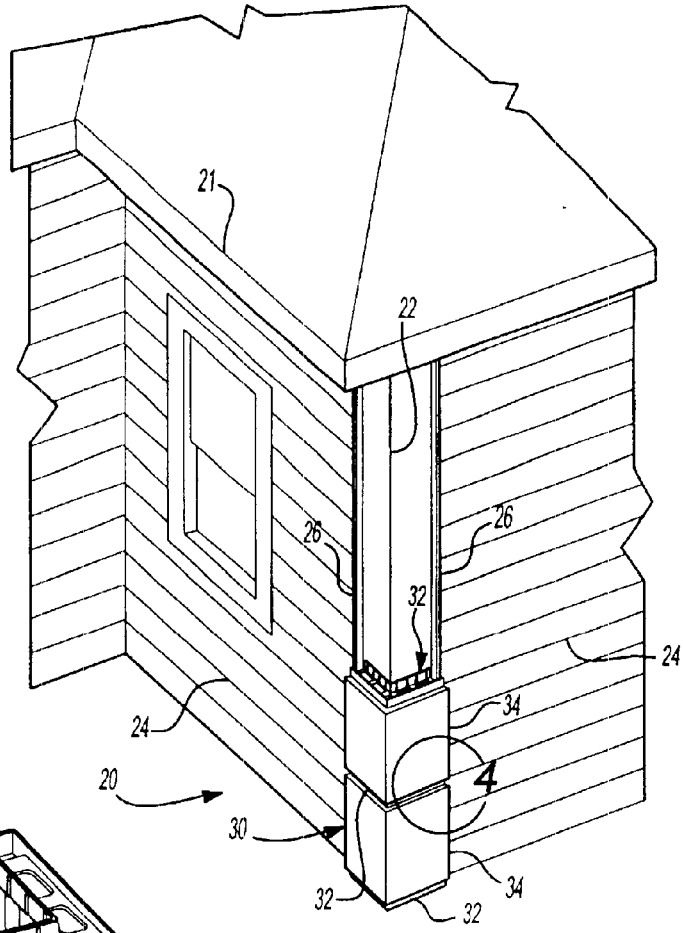
FIG. 1 is a general perspective view of a building disclosing a partial installation of molded corner blocks embodying the present invention.
Figure 3:
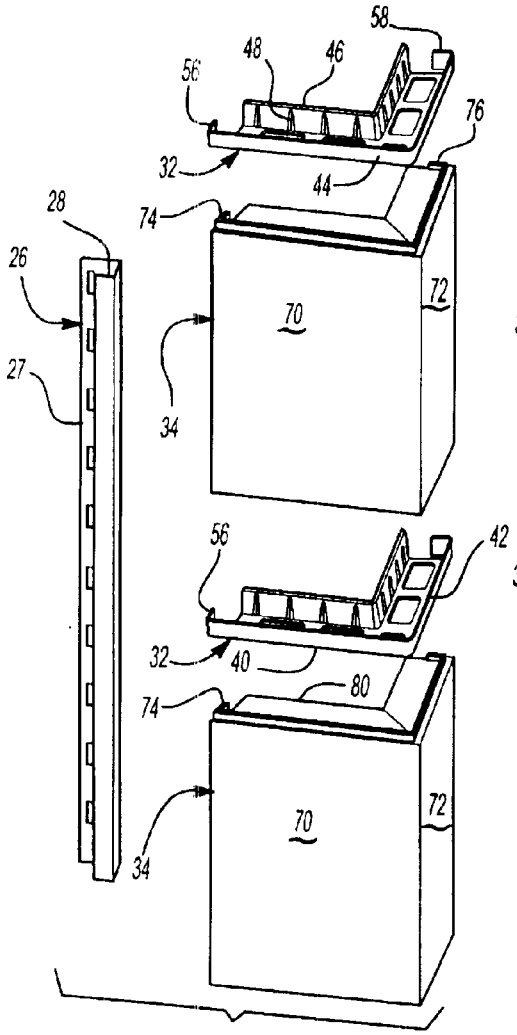
FIG. 3 is an exploded perspective view of the block combination shown in FIG. 2 illustrating the various components thereof.
Figure 4:
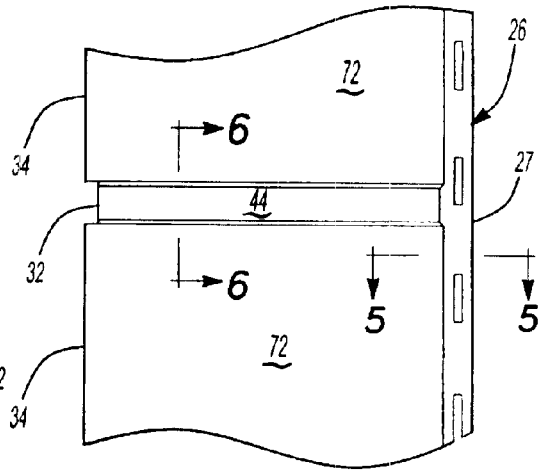
FIG. 4 is an enlarged view of area 4 designated in FIG. 1.
Figure 6:
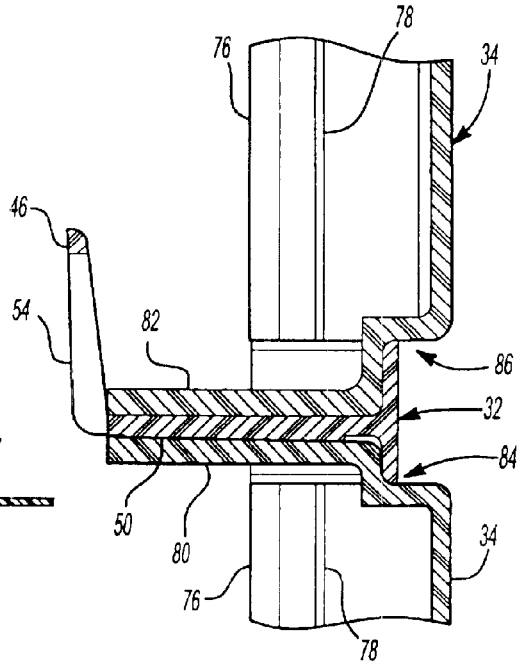
FIG. 6 is a cross-sectional elevation view of FIG. 4 taken along the Line 6—6 showing the interconnection of two adjacent corner blocks and a mortar joint.
Figure 5:
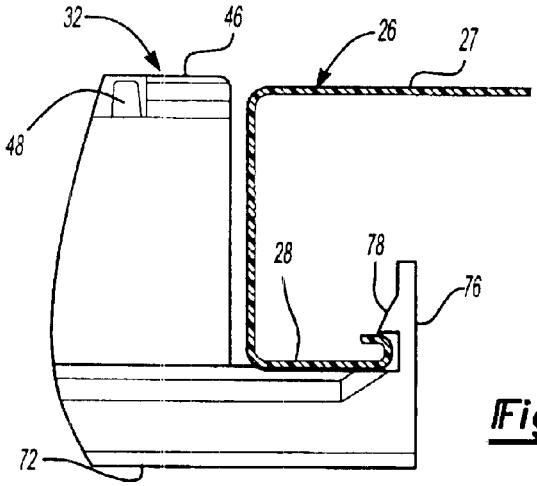
FIG. 5 is a top plan section taken along the Line 5—5 of FIG. 4 showing the block element engaged with the J-channel.
Figure 7:
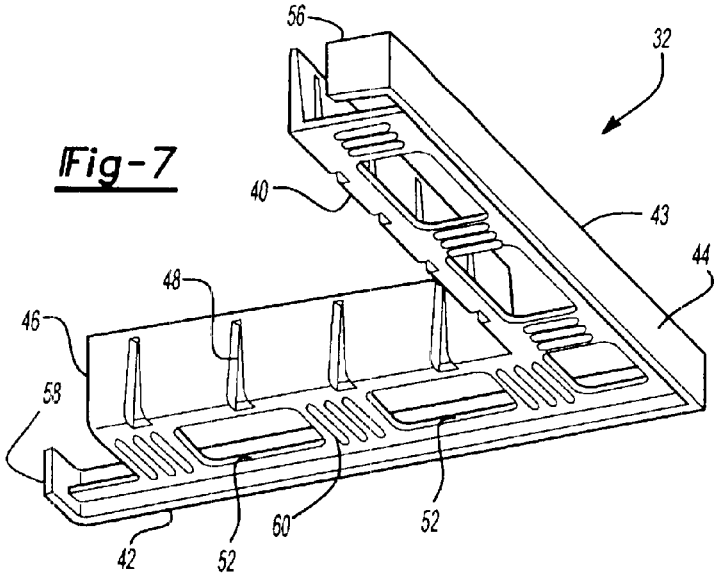
FIG. 7 is a bottom perspective view of a mortar joint.
Figure 8:
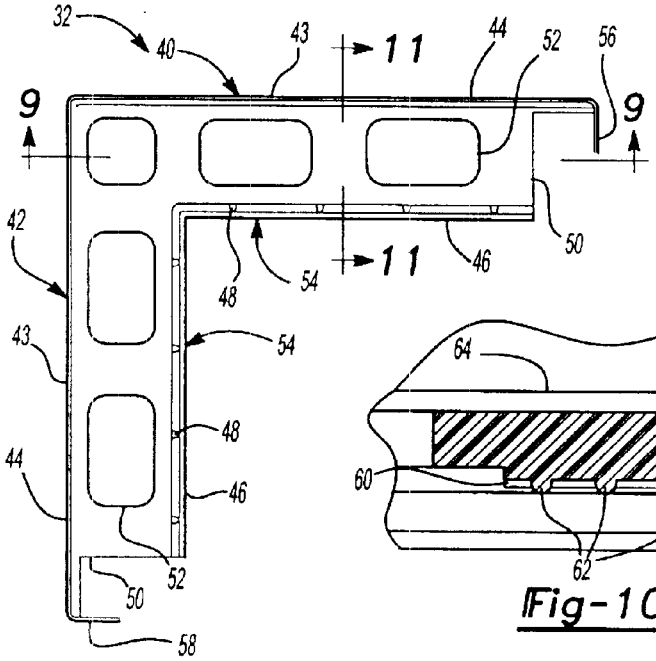
FIG. 8 is a top plan view of the mortar joint of FIG. 7.
Figure 10:
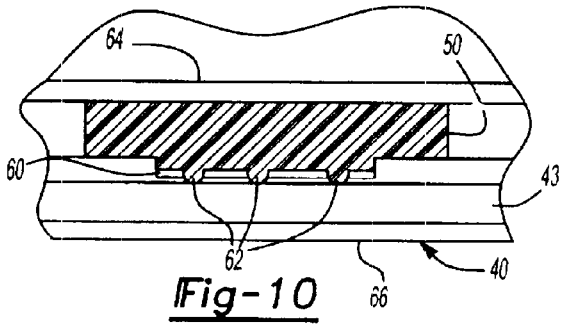
FIG. 10 is an enlarged view of the segment designated by the numeral 10 in FIG. 9.
Figure 9:
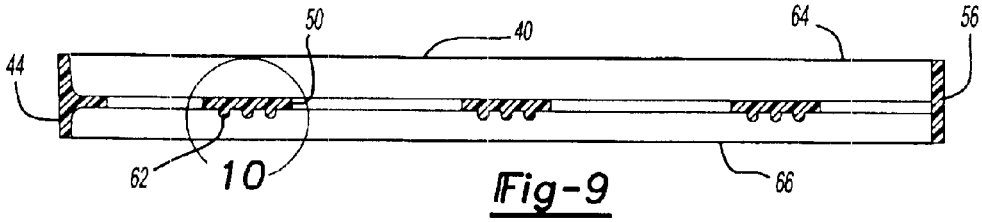
FIG. 9 is a cross-sectional view of FIG. 8 taken along the Line 9—9.

Turning to the drawings, FIGS. 1–3 show a building 20 having a portion of a decorative corner assembly 30 installed on a corner of the building 20. Intersecting sides of the building have a plurality of siding elements 24 installed thereon which terminate proximate to building corner 22 at brackets 26, here illustrated in the configuration of a J-channel. Those skilled in the art will understand that J-channel 26 extends from roof 21 to the bottom of the building at the ends of siding 24 on both intersecting walls. Portions of the J-channel normally installed have been removed for clarity. The decorative corner assembly 30 extends from the base of the building walls to roof 21 by first installing a mortar joint 32 at the base of the wall and then in alternating fashion affixing corner blocks 34 and additional mortar joints 32, one on top of the other, until the installation extends to the underside of roof 21. Thus, the corner block system 30 disclosed herein is comprised of two basic elements, mortar joint 32 and corner block 34.

Referring now to FIGS. 7–11, mortar joint 32 comprises first and second legs 40 and 42 joined together at one end, and, in the preferred embodiment form a right angle relationship to fit on an exterior building corner where the walls form a right angle. Those skilled in the art will readily appreciate that legs 40 and 42 can be arranged at any angle to conform to walls joining at angles other than 90 degrees. Each of legs 40 and 42 comprises a front cap 43 which has a decorative face 44. Decorative face 44 can be textured and colored to produce a desired effect, and in the preferred embodiment is textured and colored to give the appearance of mortar joining two corner blocks 34. Front cap 43 has a top edge 64 and a bottom edge 66. A web 50 extends rearward from front cap 43 intermediate to edges 64 and 66.

An attachment flange 46 extends upwardly from a rear end of web 50 and includes a rear face 54 for abutting against the wall structure to which it is to be attached. Attachment flange 46 defines a plurality of attachment slots 48 therethrough wherein slots 48 in the preferred embodiment are vertically oriented and regularly spaced along attachment flange 46.

Web 50 defines a plurality of apertures 52 wherein apertures 52 function to minimize the amount of material (i.e., molded plastic) needed to form mortar joint 32. In the preferred embodiment, web 50 also includes on a lower surface thereof between adjacent apertures 52 attachment pads 60. Each attachment pad 60 includes a plurality of intermittently spaced weld beads 62 extending the length of attachment pad 60. The purpose and function of attachment pad 60 and weld beads 62 are discussed below.

Front cap 43 at its free end on leg 40 has a first side flange 56 extending rearwardly therefrom in a cantilevered manner and terminates at a point intermediate between front cap 43 and attachment flange 46. In like manner, front cap 43 of second leg 42 at its free end has a second side flange 58 extending rearwardly therefrom in a cantilevered manner and also terminates at a point intermediate between front cap 43 and attachment flange 46.

Referring now to FIGS. 12–14, corner block 34 is shown in its various views. Comer block 34 comprises first and second decorative faces 70 and 72, which are joined at one edge thereof to define an angular relationship therebetween. Decorative faces 70 and 72 can also be textured and colored to produce a desired effect such as quarried stone. The angular relationship of first and second decorative faces 70 and 72 is the same as the angular relationship of legs 40 and 42 of mortar joint 32. In the preferred embodiment, the relationship is that of a right angle.

Each of decorative faces 70 and 72 has a top flange extending rearwardly from an upper edge of each of faces 70 and 72. Faces 70 and 72 in combination with top flanges 80 define at their apex a top shoulder 84 extending about the periphery of corner block 34. Additionally, a bottom flange 82 extends rearwardly from a bottom edge of faces 70 and 72 and in combination with faces 70 and 72 define a bottom shoulder 86 extending about the periphery of corner block 34. In this manner, faces 70 and 72 are bounded at their upper and lower edges by shoulders 84 and 86, respectively.

First decorative face 70 further includes at its free edge a first arm 74 extending rearwardly therefrom such that first arm 74 terminates at a point intermediate between decorative face 72 and the rear edges of upper and lower flanges 80 and 82. Arm 74 further includes a protrusion 78 on an inner surface and extending the vertical length of arm 74. Protrusion 78 is oriented substantially parallel to the rear edge 75 of arm 74. Decorative face 72 has, in like manner, a second arm 76 as a mirror image of first arm 74. Second arm 76 also includes on an inner face thereof and extending substantially parallel to rear edge 77 a like protrusion 78.

In use, and again referring to FIGS. 1–6, a building 20 on which corner block system 30 is to be installed in conjunction with exterior siding 24 utilizes the brackets or J-channels 26 of the siding system. J-channel 26 is affixed to the bare wall a predetermined distance from corner 22. The predetermined distance for attaching J-channel 26 is dependent upon the width of blocks 34 and the widths of legs 40 and 42 of mortar joint 32. J-channel 26 is affixed with long leg 27 abutting the wall such that the channel defined by long leg 27 and short leg 28 is oriented away from corner 22. A second J-channel 26 is affixed to the adjoining wall a second affixed distance from corner 22. In the preferred embodiment, the two J-channels 26 are equal distance from corner 22. Those skilled in the art will readily recognize that this arrangement accommodates corner blocks 34 having decorative faces 70 and 72 of equal widths. However, corner blocks 34 are also anticipated to have decorative faces 70 and 72 of different widths which would therefore require J-channels 26 to be spaced from corner 22 as a function of the individual widths of decorative faces 70 and 72. The length of legs 40 and 42 of mortar joint 32 are also a function of the width of decorative faces 70 and 72.

Once J-channels 26 have been attached to the exterior walls of building 20, a mortar joint 32 having its bottom surface aligned with the bottom of the intersecting walls is placed against building 20 such that first side flange 56 of mortar joint 32 has its interior face abutted against and concealing lip 29 on short leg 28 of J-channel 26. In a like manner, second side flange 58 of mortar joint 32 has its inside face abutted against and concealing lip 29 of the second J-channel 26. Attachment flange 46 is abutted to the intersecting walls and is affixed thereto by engaging nails or threaded screws to the wall through vertical slots 48 in attachment flange 46. The plurality of vertical slots 48 and their regularly spaced arrangement, provides the installer with a selection of locations so that the installer can use the most optimum attachment location according to the unique structure of the intersecting walls.

Next, a corner block 34 is snapped into position by engaging first and second arms 74 and 76 over lip 29 of J-channel 26. Corner block 34 is retained against the wall by protrusion 78 on first and second arms 74 and 76 engaging and capturing lip 29 of each J-channel 26 behind the respective protrusion 78. Further, corner block 34 is vertically positioned such that bottom shoulder 86 is abutted against upper edge 64 of front cap 43 of mortar joint 32. Additionally, bottom flange 82 is also abutted at least in part against the top surface of web 50 of mortar joint 32.

Next, a second mortar joint 32 is placed above corner block 34 and is positioned such that its attachment flange 46 abuts the intersecting walls, and first and second side flanges 56 and 58 encompass lip 29 and the short leg 28 of J-channels 26. The second mortar joint 32 is positioned such that the bottom surface of its web 50 abuts the top surface of top flange 80 of corner block 34, and has lower edge 66 of its front cap 43 abutted against upper shoulder 84 of corner block 34. The second mortar joint 32 is then affixed to the walls of building 20 utilizing fasteners such as nails or threaded screws through vertical slots 48. A second corner block 34 is then installed above second mortar joint 32 in a manner similar to the installation of the first corner block 34. This process is continued by alternate installation of successive mortar joints 32 and corner blocks 34 until the corner block installation reaches the top of the walls. In those cases where the remaining distance to the top of the wall is less than the height of one corner block, the final corner block 34 can be trimmed so that its vertical dimension corresponds to the remaining space to the top of the wall thus finishing out the corner block installation on the house.

The length of side flanges 56 and 58 of mortar joint 32 and first and second arms 74 and 76 of corner blocks 34, as stated earlier, when installed do not extend to the wall surface. Therefore, as can be representatively seen in FIG. 5, there remains an opening between the end of second arm 76 and long leg 27 of J-channel 26. This opening is of sufficient width to permit the insertion of the cut ends of siding elements 24 into J-channel 26 to provide an aesthetically pleasing finished look.

In the preferred embodiment, a mortar joint 32 is prebonded to the top of a corner block 34 so that the combined mortar joint 32 and corner block 34 are installed as a single assembly. This assembly is affixed to the walls of building 20 with fasteners through vertical slots 48. The bonding of mortar joint 32 to corner block 34 is accomplished at the interface of the top surface of upper flange 80 of corner block 34 and attachment pads 60 on the bottom surface of web 50. Those skilled in the art are familiar with the various methods of bonding plastic surfaces one to the other such as with cements or solvents or other known methods. In the preferred embodiment, attachment pads 60 have a plurality of longitudinal weld beads 62 on a bottom surface such that when the mortar joint 32 is abutted against the top of corner block 34, beads 62 contact the upper surface of top flange 80. The two elements are then ultrasonically welded one to the other such that the beads 62 and the surface of flange 80 in mutual contact experience localized melting and subsequent re-hardening thereby resulting in mortar joint 32 being permanently affixed to the top of corner block 34.

In the foregoing description, those skilled in the art will readily appreciate that modifications may be made to the invention without departing from the concepts disclosed herein. Such modifications are to be considered as included in the following claims, unless these claims expressly state otherwise.

What is claimed is:

1. A corner block system for covering exterior corners of intersecting building walls, said corner block system comprising:

two elongated vertically oriented brackets one attached to each of the intersecting walls;

a plurality of mortar joints, each said mortar joint having at least two legs arranged in a predefined angular relationship, each leg having a rear attachment flange for abutting one of the intersecting walls and a front cap spaced from said attachment flange;

a plurality of corner blocks, each said corner block having at least two faces arranged in a like predefined angular relationship and joined along adjacent edges thereof, each face having at an edge opposite from said joined edge an arm extending rearwardly therefrom; wherein:

said blocks are vertically arranged between said vertically oriented brackets, each arm of said blocks retainingly engaging said bracket, and one of said mortar joints is interposed between adjacent ones of said corner blocks wherein a top of a bottommost of said adjacent corner blocks abuts a bottom of said front cap and a top of said front cap abuts a bottom of a topmost of said adjacent corner blocks.

2. The corner block system according to claim 1 wherein said mortar joint and said corner block are molded from plastic.

3. The corner block system according to claim 1 wherein said corner blocks define a top shoulder at a top edge of each said face and a bottom shoulder at a bottom edge of each said face and further wherein said top shoulder abuts a bottom edge of said cap of said mortar joint abutted thereto and said bottom shoulder abuts a top edge of said cap of said mortar joint abutted thereto.

4. The corner block system according to claim 3 wherein said cap of each said mortar joint has an exterior face and further wherein said mortar joint face is recessed with respect to an adjacent corner block face.

5. The corner block system according to claim 4 wherein each said corner block includes a top flange extending rearwardly from a top of each said adjoined face and a bottom flange extending rearwardly from a bottom of each said adjoined face.

6. The corner block system according to claim 5 wherein a rearward extending length of said top and said bottom flanges on said corner blocks is greater than a rearward extending length of said arms on said corner block.

7. The corner block system according to claim 5 wherein each said mortar joint includes a web extending rearwardly from said front cap intermediate said cap top edge and said cap bottom edge to said attachment flange.

8. The corner block system according to claim 7 wherein said web includes at least two attachment pads on a bottom surface thereof.

9. The corner block system according to claim 8 wherein said attachment pads are affixed to a top surface of said top flange of an adjacent one of said corner blocks.

10. The corner block system according to claim 9 wherein said attachment pads are affixed to said top flange surface by ultrasonic welding.

11. The corner block system according to claim 1 wherein said arms on said corner blocks include a protrusion on an inner face thereof, said protrusion being proximate to a free edge of said arm.

12. The corner block system according to claim 11 wherein said protrusion engages a free edge of said bracket for retaining said corner block on said bracket.

13. The corner block system according to claim 12 wherein each said arm extends rearwardly from substantially an entire vertical length of said face.

14. The corner block system according to claim 1 wherein said mortar joint includes a flange extending rearwardly from a free end of each of said front caps.

15. The corner block system according to claim 1 wherein said attachment flange on said mortar joint defines a plurality of apertures therethrough.

16. A decorative corner block assembly for covering exterior corners of intersecting building walls, said corner block assembly comprising:

a corner block having at least two faces arranged in a predefined angular relationship and joined along adjacent edges thereof, each face having a top flange extending rearwardly from a top edge thereof and at an edge opposite from said joined edge an arm extending rearwardly therefrom; and a mortar joint affixed to said top flanges, said mortar joint having at least two legs arranged in a like predefined angular relationship, each leg having a rear attachment flange for abutting one of the intersecting walls and a front cap spaced from said attachment flange wherein a bottom edge of said front cap abuts a top of said corner block.

17. The corner block assembly according to claim 16 wherein said mortar joint and said corner block are molded from plastic.

18. The corner block assembly according to claim 16 wherein said corner block defines a top shoulder at a top edge of each said face and a bottom shoulder at a bottom edge of each said face and further wherein said top shoulder abuts said bottom edge of said cap of said mortar joint affixed thereto.

19. The corner block assembly according to claim 18 wherein said cap of said mortar joint has an exterior face and further wherein said mortar joint face is recessed with respect to an adjacent corner block face.

20. The corner block assembly according to claim 19 wherein said corner block includes a bottom flange extending rearwardly from a bottom of each said adjoined face.

21. The corner block assembly according to claim 20 wherein a rearward extending length of said top and said bottom flanges on said corner blocks is greater than a rearward length of said arms on said corner block.

22. The corner block assembly according to claim 21 wherein said mortar joint includes a web extending rearwardly from said front cap intermediate said cap top edge and said cap bottom edge to said attachment flange.

23. The corner block assembly according to claim 22 wherein said web includes at least two attachment pads on a bottom surface thereof.

24. The corner block assembly according to claim 23 wherein said attachment pads are affixed to a top surface of said top flange of an adjacent one of said corner blocks.

25. The corner block assembly according to claim 24 wherein said attachment pads are affixed to said top flange surface by ultrasonic welding.

26. The corner block assembly according to claim 16 wherein said arms on said corner block include a protrusion on an inner face thereof, said protrusion being proximate to a free edge of said arm.

27. The corner block assembly according to claim 26 wherein each said arm extends rearwardly from substantially an entire vertical length of said face.

28. The corner block assembly according to claim 16 wherein said mortar joint includes a flange extending rearwardly from a free end of each of said front caps.

29. The corner block assembly according to claim 16 wherein said attachment flange on said mortar joint defines a plurality of apertures therethrough.

30. A method of installing a corner block system to an exterior corner of intersecting walls of a building wherein the corner block system includes at least two elongate brackets, a plurality of corner blocks having at least two faces arranged in a predefined angular relationship and joined along adjacent edges thereof, each face having a top flange extending rearwardly from a top shoulder defined by the top flange and the face, and an arm extending rearwardly from an edge of each face opposite from the joined edge and having a protrusion on an inner surface, and a plurality of mortar joints having at least two legs arranged in a like predefined angular relationship, each leg having a rear attachment flange and a front cap spaced from said attachment flange by a web extending therebetween, said method including the steps of:

attaching one of the brackets to each of the intersecting walls a predefined distance from the corner;

abutting the attachment flange of a mortar joint to the corner substantially at a bottom edge of the intersecting walls;

attaching the mortar joint at the attachment flange to the walls;

placing a corner block on the mortar joint such that the bottom shoulder of the corner block abuts a top edge of the mortar joint cap;

engaging the arms of the corner block to a free edge of the bracket by snapping the arm protrusion over the bracket free edge;

alternatingly affixing mortar joints and corner blocks to the corner of the building in like manner until the installation reaches a top of the intersecting walls of the building.

31. The method according to claim 30 including after the last step thereof, the step of:

trimming a corner block to fit the remaining space between the last mortar joint and the roof when the vertical space therebetween is less than the height of a corner block.

32. The method according to claim 30 including after the step of attaching the first mortar joint, the step of:

bonding a mortar joint to a top of each corner block.

33. The method according to claim 30 including as a first step, the step of:

bonding a mortar joint to a top of each corner block.

* * * * *